United States Patent [19]

Prillwitz

[11] Patent Number: 4,650,116

[45] Date of Patent: Mar. 17, 1987

[54] FUEL-INJECTION DEVICE

[75] Inventor: Rolf Prillwitz, Moglingen, Fed. Rep. of Germany

[73] Assignee: L'Orange GmbH, Fed. Rep. of Germany

[21] Appl. No.: 646,379

[22] Filed: Aug. 29, 1984

[30] Foreign Application Priority Data

Aug. 31, 1983 [DE] Fed. Rep. of Germany ..... 3331336

[51] Int. Cl.[4] ..... F02M 47/00

[52] U.S. Cl. ..... 239/88; 239/93; 239/533.5; 239/600

[58] Field of Search ..... 239/88–96, 239/533.2–533.12, 452, 453, 584, 600; 267/179

[56] References Cited

U.S. PATENT DOCUMENTS

| | | | |
|---|---|---|---|
| 2,378,165 | 6/1945 | Waeber | 239/90 |
| 2,507,355 | 5/1950 | Sola | 239/533.3 X |
| 2,591,401 | 4/1952 | Camner | 239/533.3 X |
| 3,635,403 | 1/1972 | Hofken et al. | 239/90 |
| 3,777,984 | 12/1973 | Greathouse | 239/584 X |
| 4,267,128 | 5/1981 | Kobayoshi | 267/179 X |
| 4,527,738 | 7/1985 | Martin | 239/90 |

FOREIGN PATENT DOCUMENTS

| | | | |
|---|---|---|---|
| 2028453 | 12/1971 | Fed. Rep. of Germany | 239/533.3 |
| 1228327 | 4/1971 | United Kingdom | 239/533.11 |
| 2056557 | 3/1981 | United Kingdom | 239/533.9 |

*Primary Examiner*—Joseph F. Peters, Jr.
*Assistant Examiner*—Kevin Patrick Weldon
*Attorney, Agent, or Firm*—Barnes & Thornburg

[57] ABSTRACT

A fuel-injection device in which a nozzle element is directly pressed towards the front face of a guide body for the pump plunger. The guide body is provided with an enlarged slot into which a spring element can be entered from the side, which spring element loads the valve needle of the nozzle element. Thus this injection device can be made more compact than known types and is therefore especially suitable to be used in automotive vehicles.

9 Claims, 7 Drawing Figures

BEST AVAILABLE COPY

FUEL-INJECTION DEVICE

BACKGROUND OF THE INVENTION

This invention relates to a fuel-injection device for use in an internal combustion engine preferably for use in an automotive vehicle. The device includes an injection pump whose plunger is displaceably mounted in a bore of a guide body, and a nozzle element directly pressed against the front face of the guide body. The nozzle element includes a valve needle which controls the spray hole of the nozzle element. The valve needle projects into a bore beginning on the front face of the guide body and extends to a receiving space provided in the guide body. In the receiving space a spring element is arranged to press the valve needle on its valve seat, wherein laterally beside this receiving space for the spring element a fuel channel is arranged in the guide body. The fuel channel opens into the front face of the guide body and connects the working chamber of the injection pump with the nozzle element.

A fuel-injection device of this kind is known from the German specification OS No. 1,805,024. This device differs from other known designs substantially in that there is only one high-pressure sealing surface between the guide body and the nozzle element.

In this known embodiment the receiving space for the spring element is formed as a pocket hole centrally from the front face of the guide body. Thus the diameter of the bore on the front face of the guide body is at least as large as the diameter of the spring element which has to be accommodated in this receiving space. Because the spring diameter depends on the desired opening pressure of the valve and because a certain wall thickness is necessary between the bore leading to the receiving space and the fuel channel to provide stability, the known embodiment has a relatively large diameter on the front face of the guide body and thus the diameter of the nozzle element is relatively large. A fuel-injection device of this kind with a relatively large space requirement can be used without difficulty for motors of a larger size as used in the ship industry, however the utilization for a motor vehicle engine raises problems. Moreover the extent of the density at the front face of the guide body depends on the size of this front face, so that a smaller design is preferred.

SUMMARY OF THE INVENTION

Thus the present invention provides a fuel-injection device initially comprising only one high-pressure sealing surface. The device can be built more compactly without harmful strain on the material even at high delivery pressure and/or endures the high injection pressures which are usual at present, even after a longer service time. The fuel injection device is so produced can be manufactured and mounted simply.

The invention is based on the principle of diminishing the diameter of the bore on the front face of the guide body as compared to the bore diameter of the known devices by not requiring the spring element to be axially inserted in the receiving space, but instead enabling it to be inserted laterally from a generated surface of the guide body. Thus in embodiments according to the present invention, the diameter of the bore is not determined by the diameter of the spring element, but by the diameter of the valve needle projecting into this bore, which diameter is normally much smaller. Thus either the wall thickness between the bore and the fuel channel is enlarged, so that the device is suitable for higher injection pressures or, in comparison with embodiments of the same wall thickness, the fuel channel can be arranged closer to the axis of the guide body.

From U.S. Pat. No. 3,777,984 is known a device with an injection nozzle in which the receiving space for the spring element is formed as a transverse groove, and through which the spring element is laterally insertable. However in this known example the bore has a constant diameter from the front face to the receiving space for the spring element. In a first embodiment of the cited patent, the diameter of the bore is adapted to the diameter of a stud on the valve needle, which stud extends through this bore and protrudes in the receiving space for the spring element. Thus in this case one needs a relatively long valve needle and the axial length of the nozzle has to be increased. The other embodiment shown in this reference patent does not have this disadvantage. In this embodiment the stud on the valve needle is supported on the shank of a stilt or spacer member protruding into this bore in line with the present invention. Because the diameter of this shank of the stilt is larger than the diameter of the valve stud and the bore has a constant diameter reaching as far as the front face in comparison with the first-mentioned embodiment, the diameter of the nozzle would have to be increased if an damaging strain on the material is to be prevented while the other conditions remain the same.

In contrast thereto it is a principle of the present invention to provide in the area of the front face a bore adapted to the diameter of the valve stud, however in the section following the receiving space to provide the customarily larger diameter of the shank of the stilt.

According to U.S. Pat. No. 3,777,984 an adjusting screw is provided which is guided in a bore in the wall limiting the transverse groove on the side opposite to the valve needle. Such a design may be possible in the case of a nozzle, however problems with regard to stability arise, when this feature is applied to the guide body of an injection pump, because this wall is loaded with the high pump pressure coming into existence in the adjacent pump chamber. Thus the conditions given in the case of a nozzle cannot so easily be applied to a so-called pump-nozzle unit.

It is therefore significant for the present invention that there is provided a girder directly supported on the wall thereby limiting the transverse groove to the side of the plunger.

Together with a feature in which there is a conical enlargement of the bore, this feature allows simple production and mounting of a device using the present invention. The spacer member and the spring member can both be inserted in the transverse groove at an angle to the longitudinal direction of the guide body and swivelled into the operating position by a lateral pressure, whereby the girder glides along the wall which limits the transverse groove towards the side of the plunger. This mounting action is very simple and can be rapidly carried out without using specific tools. In contrast thereto, in known construction devices the stilt can only be inserted in the bore in the axial direction and the girder supported on the opposite side of the spring element cannot be simply pushed into the transverse groove. The girder has rather to be pressed below the adjusting screw under prestress of the spring element, if a time-consuming adjustment of the adjusting screw is to be avoided at any rate. Such a time-consuming ad-

BEST AVAILABLE COPY justment of the valve opening pressure in contrast thereto is not necessary in the embodiment of the present invention.

A preferred embodiment according to the invention is obtained, when the portion of the fuel channel ending in the front face of the guide body is slantingly arranged relative to the axis of the guide body. This permits the use of series produced nozzle elements of a small size. Of course care must be taken to ensure that at the level of the receiving space of the spring element, the wall thickness to the fuel channel is sufficient.

Due to the diminution of the end area of the transverse groove towards the nozzle element, the spacing of the fuel channel from the axis of the guide body can be further diminished, when the fuel channel is slantingly arranged. Especially when the diameter of the pump working chamber is only slightly larger than the width of the receiving space for the spring element and therefore the portion of the fuel channel leading to the working chamber extends slantingly to the axis of the guide body, the cross-section of the transverse groove in the end area towards the plunger will also be tapered, so that there is a sufficient wall thickness of the fuel channel without having to enlarge the length of the guide body.

These end areas can have a trapezoid cross-section. However a semi-circular cross-section is preferred in order to ensure a uniform strain without strain peaks in the corner areas of the transverse groove. Thus, the cross-section of the girder has to correspond to the end area of the transverse groove, so that guide surfaces are formed on the guide body and on the girder for laterally pushing the girder into the transverse groove. When the girder has a semi-circular cross-section, an otherwise possible swivelling motion of the girder about an axis in the longitudinal direction of the transverse groove is prevented by a holding pin anchored in the guide body and engaging in a groove of the girder.

The particularly shape of the bore between the front face of the guide body and the receiving space for the spring element can be produced in different ways. In one example, a bore can be worked from the front face of the guide body. The diameter of this bore corresponds to the diameter of the shank of the stilt. Thereafter the bore is enlarged over a certain portion from the same side and in this portion a guide bushing is preferably pressed into it, the bushing preferably having been hardened to serve as a stop for the valve needle. The diameter of the bore in this bushing is sized to receive the diameter of the stud on the valve needle.

In another embodiment, a bore from the front side is produced which corresponds to the diameter of the stud on the valve needle. The section with the enlarged diameter is made by slantingly insertion a drill with a corresponding diameter into the transverse groove from each side. The bore created in this manner is then conically enlarged in the longitudinal direction of the transverse groove.

Preferably a helical spring is used as a spring element. In an especially preferred embodiment a plurality of helical compression springs (preferably three) are inserted in the transverse groove. In this way helical compression springs with a smaller diameter can be used and thus also the width of the transverse groove can be diminished.

DETAILED DESCRIPTION

Figure 1:
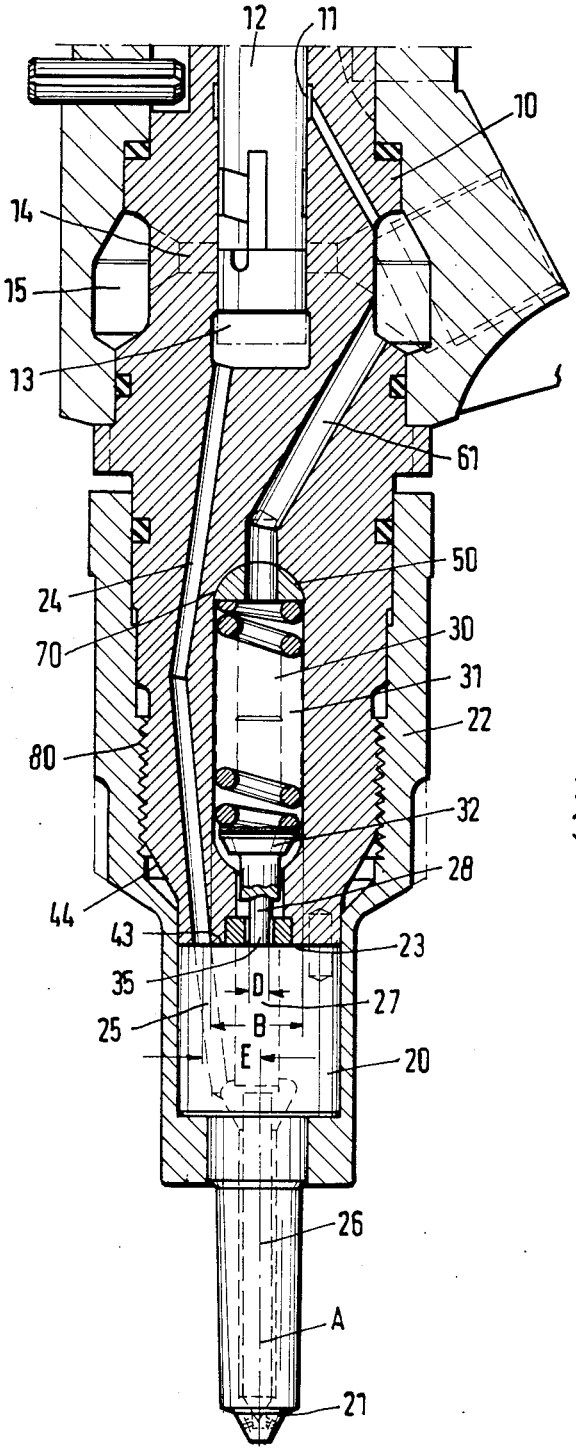
FIG. 1 is a side view in section of a first embodiment of the invention.

In FIG. 1 there is shown a fuel injecting device having a guide body designated 10, which guide body has an axial bore 11 in one end in which a plunger 12 is mounted axially displaceably. This bore 11 is formed in the guide body as a blind hole. The pump working chamber 13 is supplied with fuel in a known manner from an annular space 15 via a transverse bore 14 communicating with bore 11.

A nozzle element as a whole designated 20 comprising spray holes 21 in its free end is directly pressed against the free front face 23 of the guide body 10 by means of a threaded inner surface in tubular housing 22. Thus this fuel-injection device has only one high-pressure sealing surface in the area of this front face 23. Fuel is supplied to the nozzle element 20 from the pump working chamber 13 via a channel 24. This fuel channel 24 opens into front face 23 and continues into the nozzle element in a channel portion 25. The spray holes 21 of nozzle element 20 may be controlled in a known manner by the valve needle 26 which has a collar 27 and a following stud 28 with a smaller diameter.

The guide body 10 is provided with an axially elongated receiving space 30 for the spring element 31 which, via a stilt or spacer member 32 which acts upon the stud 28 and thus presses the valve needle on its valve seat. The spacer member has a conic flange 33 and a shank 34. The shank 34 and the stud 28 on the valve needle thereby project from opposite directions into a bore 35, which originates from the receiving space 30 and opens into the front face 23 of the guide body 10.

It is essential for the present invention that the receiving space 30 be formed with a transverse groove 40 which is open on at least one side, so that space extends on at least one side of the generated surface 41 of the guide body 10. In the embodiments shown herein the transverse groove 40 is arranged in this guide body 10 as a through-going slot perpendicular to a plane cutting the fuel channel 24 and the axis A of the guide body 10. The spring element 31 is pushed into this transverse groove transversally to its direction of effect and directed into its central position in which it loads the valve needle.

Thus it becomes possible to diminish the diameter D of the bore 35 in comparison with known embodiments. In the embodiment according to FIGS. 1 and 2, first a bore is made in the guide body 10 from the front face 23. The diameter D1 of this bore is adapted to the diameter of the shank 34 of the stilt 32. Thereafter a portion of the bore 35 ending towards the front face 23 is widened. In this portion is inserted a guide bushing 42 to receive the stud 28 on the valve needle. This guide bushing is preferably hardened and serves as a stop face for the collar 27 on the valve needle 26. The diameter D of the bore in bushing 42 is sized to the diameter of the stud 28 to receive the stud within the bushing bore 35.

It can be seen from FIG. 1 that the diameter D of the bore 35 is smaller on the front face 23 of the guide body than the width B of the receiving space 30 for the spring element 31. In this case the width B corresponds approximately to the diameter of a helical compression spring which serves as a spring element in the embodiment according to FIGS. 1 and 2. In the plane of FIG. 1, i.e., the plane cutting the fuel channel 24 and the bore 35 the diameter D of the bore 35 is thus smaller than the width B of the receiving space 30. Thus the spacing E from the axis A of the guide body 10 and the bore 35, which is normally centrally arranged to the edge of space 30 in this plane can also be diminished without weakening the thickness of the wall portion 43 between this fuel channel 24 and the bore 35. The portion of the fuel channel 24 ending in the front 23 is slantingly arranged relative to the axis A of the plunger (as can be seen in FIG. 1) which means that the spacing of this fuel channel from this axis is smaller in the area of the front face 23 of the guide body 10 than at the level of the receiving space 30. Thus the diameter on the front face and thereby the sole high-pressure sealing surface can be diminished when the guide body tapers conically towards the front face 23 as indicated at 44.

Figure 2:
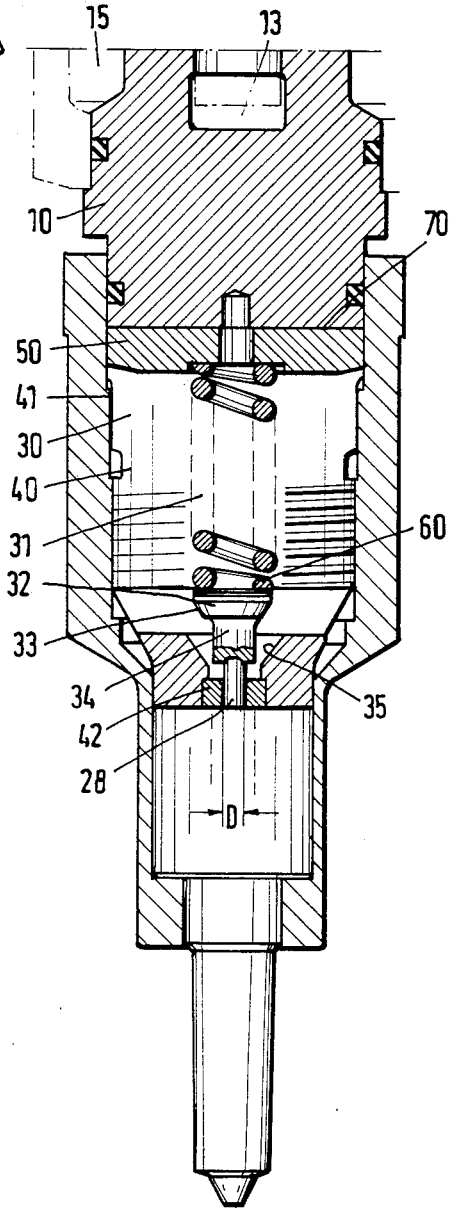
FIG. 2 is a sectional view of the embodiment of FIG. 1 rotated 90° from the showing of FIG. 1.

In the central area, the cross-section of the transverse groove 40 in the plane of FIG. 2 approximately is slightly larger than the cross-section of the nozzel element 20 and that its axial ends both the end toward the nozzle element and the end towards the plunger 12 are formed semi-circularly. Thus in the end areas, the transverse groove 40 tapers also on the side facing the fuel channel 24, so that the channel can be formed closer to the axis A without weakening the material between this fuel channel 24 and the end areas of the transverse groove 40. Of course, other shapes of the cross sections in the end areas of the transverse groove are possible so that this end area is formed in such a way that the conic flange 33 on the spacer member 32 can be accommodated therein without needing additional space. The upper semi-circular end area of the transverse groove 40 is filled by a girder or support member 50 on which the helical compression spring is supported on one side. In the embodiment according to FIGS. 1 to 4 this helical compression spring is directly supported on the flange 33 of the stilt 32.

Figure 3:
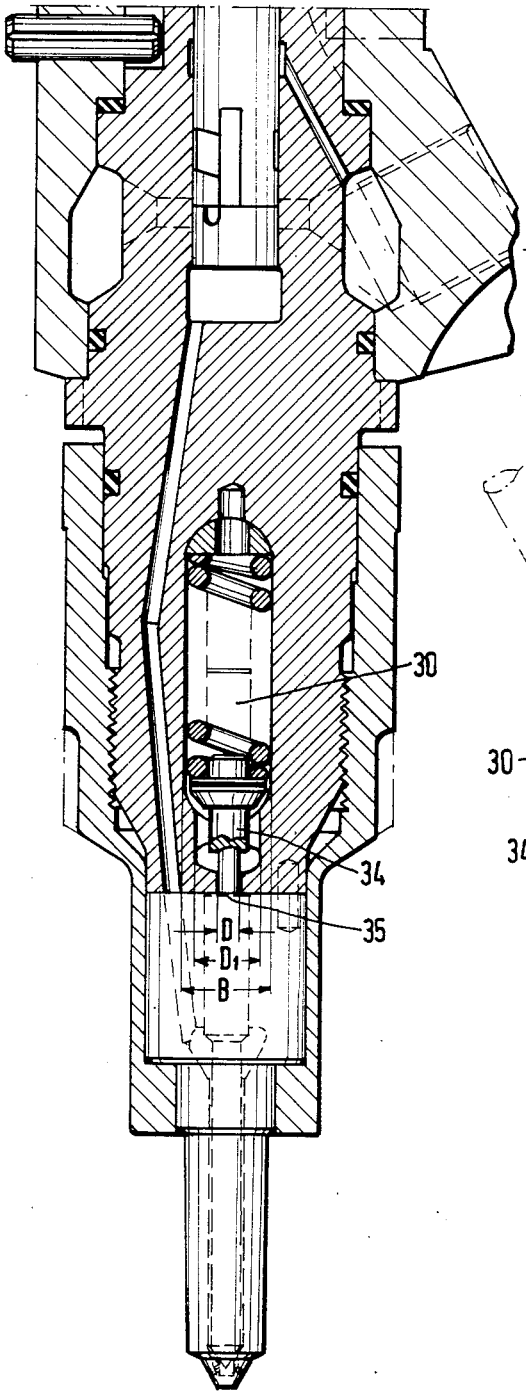
FIG. 3 is a side view in section of a second embodiment of the invention.
Figure 4:
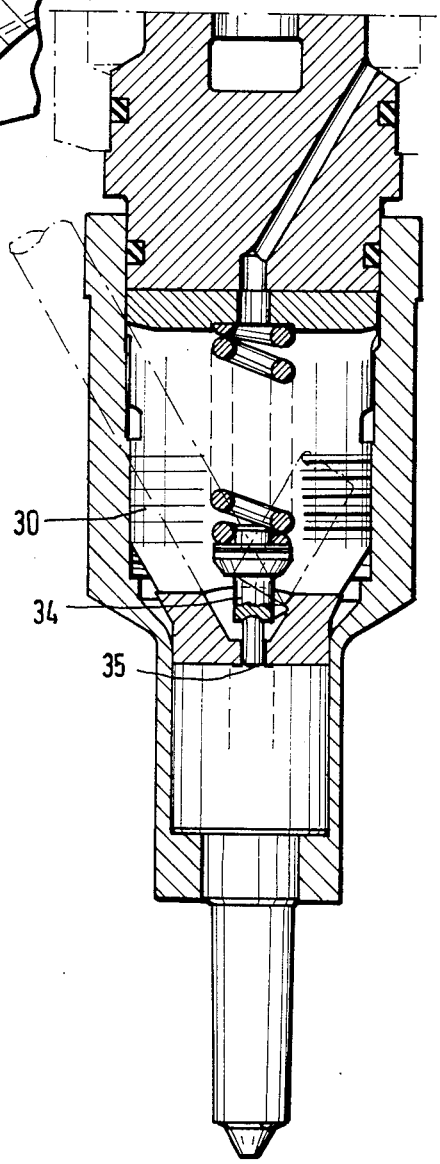
FIG. 4 is a sectional view of the embodiment of FIG. 3 rotated 90° from the showing of FIG. 3.

The embodiment of FIGS. 3 and 4 differs from that of FIGS. 1 and 2, in that the bushing 42 (of FIGS. 1 and 2) is omitted. The nozzle end of body 10 is configured and shaped to receive stud 28. The receiving space terminates at its lower end in a bore of diameter D1 to receive the stud 28.

Figure 5:
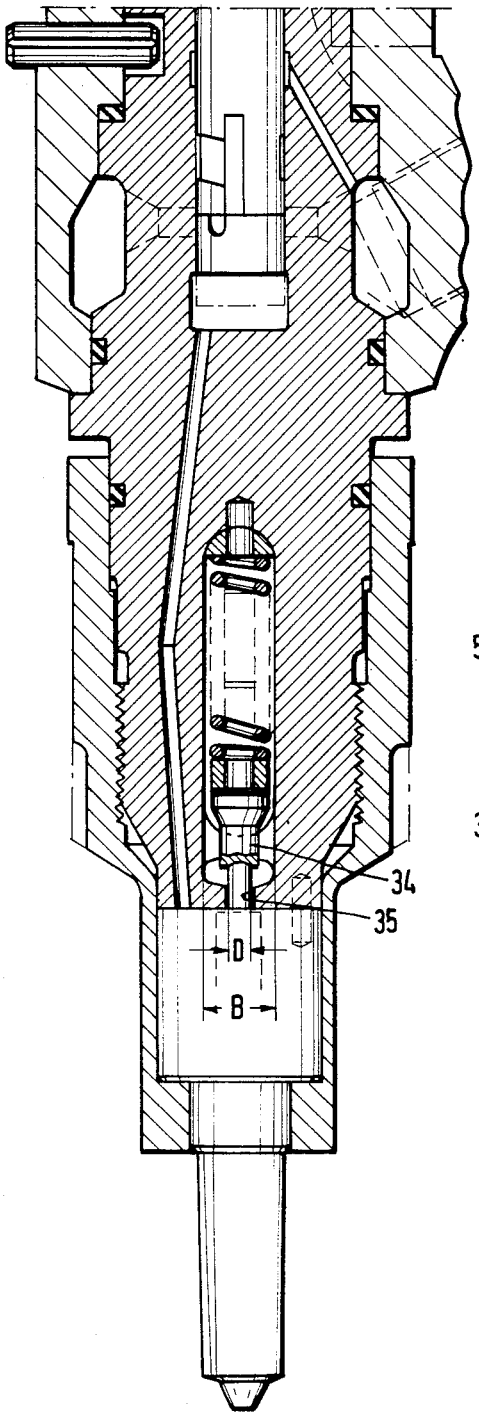
FIG. 5 is a side view in section of a third embodiment of the invention.
Figure 6:
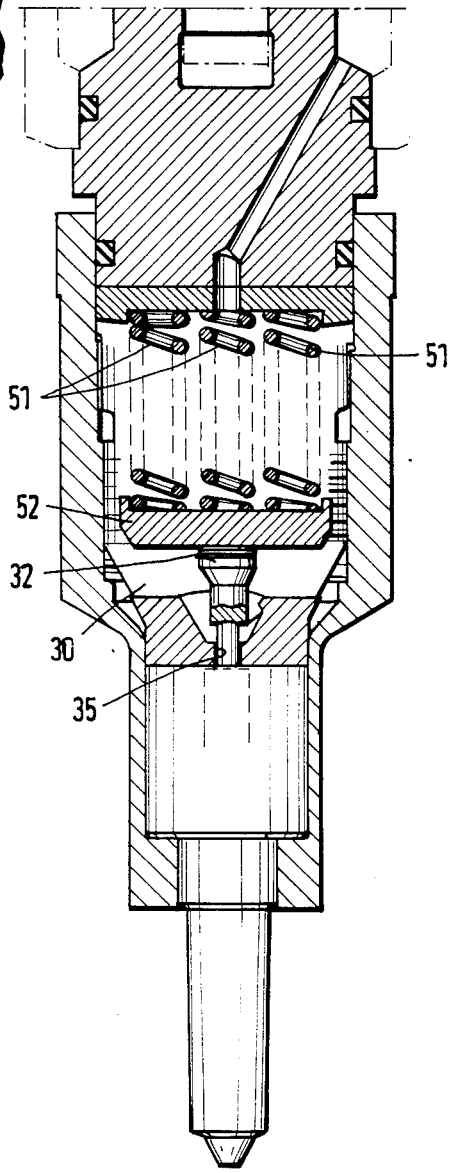
FIG. 6 is a sectional view of the embodiment of FIG. 5 rotated 90° from the showing of FIG. 5.

In the embodiment according to FIGS. 5 and 6, three helical compression springs are provided as a spring element. These helical compression springs centrally act upon the spacer member 32 via a supporting web 52. A comparison of the drawings shows that the width B of the receiving space is smaller than that of the prior art and thus the overall height as a whole either can be diminished or the device can also be used with a higher injection pressure.

For the present invention it is furthermore important that in the longitudinal direction of the transverse groove 40, the bore 35 widens towards the receiving space 30 in the manner of a cone. With a through-going transverse groove, drills can be inserted from the opposite generated surfaces of the guide body 10 as has been schematically indicated in FIG. 4. Seen from the receiving space 30 the bore (of FIGS. 5 and 6) has then a cross-section which is composed of two elliptic bores joined angularly into each other. The corresponding facts and explanation is also valid for the embodiment of FIGS. 1 and 2 and that under certain circumstances it can be sufficient that a drill if slantingly inserted only from one generated surface.

Finally it is important for the present invention that the girder 50 be directly supported on the wall 70 of the guide body 10. Wall 70 thereon limits the transverse groove to the side of the plunger. The cross-section of the end area of the transverse groove 40 can be adapted to receive and hold the cross-section of the girder 50 as FIGS. 2, 4 and 6 show. Thus the girder 50 completely fills the end area of the transverse groove 40. It is especially important that the transverse groove 40 and the girder have matching guide surfaces 71 and 72, which permit the girder 50 to be laterally inserted and to glide alongside the wall 70.

Figure 7:
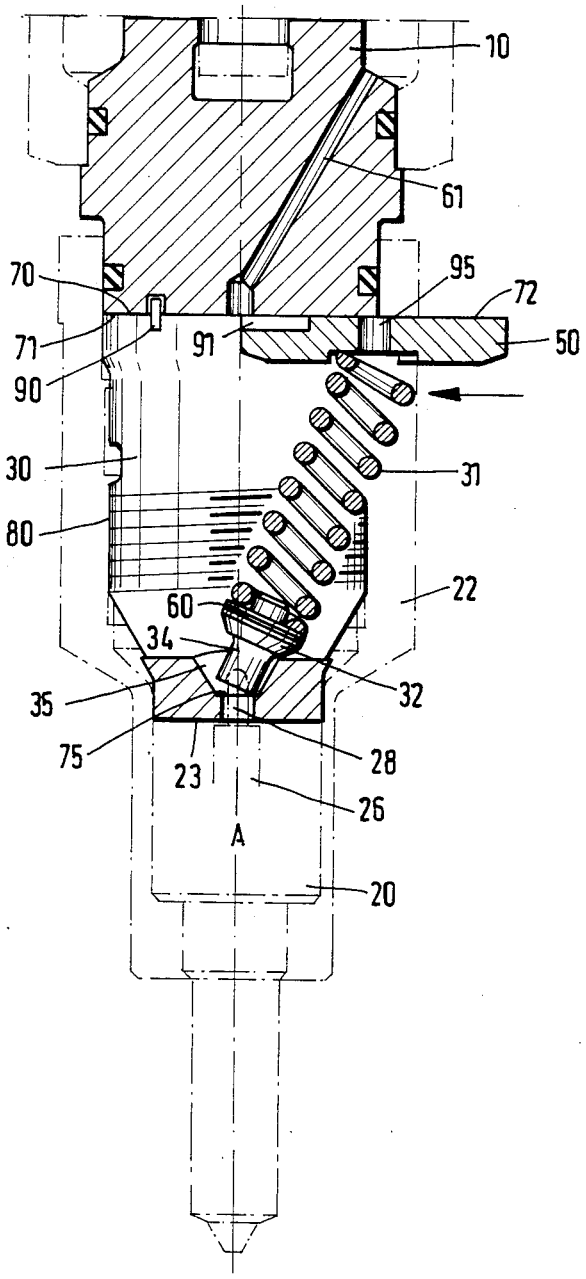
FIG. 7 is a side view of relevant portions of a still further embodiment of the invention.

The mounting process will be described by way of FIG. 7. First, the shank 34 of the stilt 32 is inserted in the bore 35 in such a way that the axis of symmetry of the shank 32 runs obliquely to the longitudinal direction A of the guide body. This is possible, because the bore 35 is tapered conically towards the receiving space 30 of the spring element. The longitudinal axis of the compression spring 31 is also arranged at an angle to the longitudinal direction A of the guide body. In this oblique arrangement of spacer member 32 and compression spring 31, the girder 50 can be inserted as shown in FIG. 7 without application of force. In this position, the shank of the spacer member 32 is supported at a shoulder 75 of the bore 35 on the passage between bore portions with different diameters. Thus in the position of the piece parts according to FIG. 7 the compression spring 31 is not tensioned. If then a force is exerted on the compression spring 31 and/or the girder 50 in the direction of the arrow, the compression spring 31 is slightly prestressed, while the girder 50 glides alongside the wall 70 of the guide body 10. The spacer member and spring element will thereby be aligned in such a way that the spring is not prestressed excessively during the mounting process, since excessive prestress would make the mounting process more difficult. On the other hand a slight prestress of the spring in the operating position should be provided, so that in the course of mounting the parts do not fall out of the transverse groove unintentionally.

When the stilt or spacer member, the spring element and the girder are inserted, the nozzle element 20 is mounted and screwed onto the guide body by means of the retaining housing 22. In this mounting process the compression spring 31 is more and more prestressed by the stud 28 of the valve needle 26, which stud impinges more and more into the bore 35. Thereby the proper valve opening pressure is provided when the nozzle element 20 rests against the free front face 23 of the guide body. For this purpose it has been found by experiment that a number of shim or spacing discs 60 have to be inserted on the flange of the stilt 32. A later adjustment of the valve opening pressure is not necessary and not possible, since retaining nut covers the transverse groove 40 laterally and thus secures the position of the girder 50, as is shown in the drawings.

In this connection it is emphasized that the thread 80 between guide body 10 and retaining nut is provided in the area of the transverse groove 40. This permits a compact construction in the longitudinal direction of the pump.

As an additional feature it is indicated in FIG. 7 that a lateral holding pin 90 anchored in the guide body 10 can engage in a groove 91 in the girder 50 and can thus prevent a swivelling of the girder 50 about an axis in the longitudinal direction of the transverse groove. This feature is only of significance, when the girder 50 has a semi-circular cross-section. When the cross-section is trapezoidal, swivelling of the girder 50 is not possible, even without the holding pin. An axial concentric bore 95 in the girder 50 may be used to provide a connection between the receiving space and a vent channel 61 which opens into the annular space.

Due to its small overall height the injection device according to the present invention is especially suitable for use in the automobiles. These designs will in particular be employed in cases, where the diameter of the pump working chamber is not essentially larger than the diameter of the helical compression spring.

Of course the use of this invention is not limited to cases in which the valve needle is moved opposite to the direction of flow of the fuel to the opening of the spray holes. The design can also be advantageously used with so-called uni-flow nozzles.

It is also emphasized that it is an important factor that the effective straight of the wall portion 43 between the fuel channel 24 and the bore 35, into which the valve needle stud 28 impinges, does not fall below a given value. It is true that in the embodiment according to FIGS. 1 and 2, the bore 35 on the front face 23 of the guide body has originally a larger diameter than the valve needle stud. However by the use of the guide bushing 42 the effective diameter of the bore 35 is adapted to the diameter of the valve needle stud 28 and at the same time the effective substance of the wall portion 43 is again increased. Of course the example of FIGS. 3 to 7 are more advantageous and simpler, because here the use of a guide bushing is not necessary and the bore 35 in the guide body is directly sized relative to the diameter of the valve needle stud 28.

What is claimed is:

1. A fuel-injection device comprising an injection pump having a working chamber with a plunger displaceably mounted in an opening of a guide body, and a nozzle element directly pressed against a front face of the guide body and comprising a valve needle which controls a spray hole of said nozzle element, which valve needle projects into a bore at the front face of the guide body and extending to a receiving space provided in the guide body, in which receiving space is arranged a spring element which presses the valve needle on its valve seat, wherein a fuel channel is arranged in the guide body laterally beside the receiving space for the spring element, said fuel channel opening into the front face of the guide body and connecting the working chamber of the injection pump with the nozzle element, the invention wherein;

(a) the receiving space for the spring element is formed as a transversely elongated groove which is open on at least one lateral side and at its other lateral side ends within the guide body, and through said transverse groove the spring element is insertable into the receiving space transversely into its position loading the valve needle by means of a support girder means which engages the spring and has a guide surface means which is slidingly engageable with an end surface area of the transverse groove and slideable during spring insertion to completely fill the end surface area of the groove when the spring is in the position loading the valve needle;

(b) the diameter of the bore at the front face of the guide body in a plane through the fuel channel and the bore is smaller than the width of the receiving space for the spring element and arranged relative to the diameter of a stud on the valve needle to receive said stud with the stud projecting into the bore;

(c) the bore at the front face having a greater diameter section adjacent the small diameter at the front face;

(d) wherein the front face bore in the section transverse to the longitudinal direction of the transverse groove is adapted to receive a shank of a spacer member resting against the front face of the valve needle stud;

(e) wherein said front face bore is tapered conically in the longitudinal direction of the transverse groove; and (f) wherein the spacer element is moveable from a tilted position in the taper to an erect position as the spring is transversely inserted into the position loading the valve needle.

2. A fuel-injection device according to claim 1, in which the spacing of the fuel channel from the axis of the bore on the front face of the guide body is smaller than that at the level of the receiving space for the spring element and that the diameter of the guide body diminishes towards the front face.

3. A fuel-injection device according to claim 1, in which the transverse groove is formed in the guide body as a through-going slot perpendicularly to the plane through the fuel channel and the axis of the guide body.

4. A fuel-injection device according to claim 1, in which the central area of the cross-section of the transverse groove corresponds approximately to the cross-section of the spring element and, at least in the end area towards the nozzle element, diminishes at least on the side facing the fuel channel and in which the bottom of the transverse groove has a semi-circular cross-section.

5. A fuel-injection device according to claim 1, in which a helical compression spring presses said valve needle on its face and that the width of the transverse groove is sized to receive the diameter of said helical compression spring.

6. A fuel-injection device according to claim 1, in which several helical compression springs inserted in the transverse groove serve as a spring element, which helical compression springs act centrally upon the spacer member via a supporting web mounted on the spacer member.

7. A fuel-injection device according to claim 1, in which there is a holding pin which engages a groove in a girder and is anchored on the guide body to prevent swivelling movement of the girder about an axis in the longitudinal direction of the transverse groove.

8. A fuel-injection device according to claim 1, in which the nozzle element is held against the front face of the guide body by means of a retaining threaded housing wherein this retaining housing encloses the receiving space for the spring element laterally.

9. A fuel-injection device according to claim 1 in which at least one shim disc is interposed between a flange of the spacer member and the compression spring to set the correct valve opening pressure.

* * * * *